US008727759B1

(12) United States Patent
Wolfe

(10) Patent No.: US 8,727,759 B1
(45) Date of Patent: May 20, 2014

(54) FULLY INTEGRATED STRUCTURAL BUILDING SYSTEM

(76) Inventor: Michael J. Wolfe, New Port Richey, FL (US)

( * ) Notice: Subject to any disclaimer, the term of this patent is extended or adjusted under 35 U.S.C. 154(b) by 457 days.

(21) Appl. No.: 12/802,171

(22) Filed: Jun. 1, 2010

Related U.S. Application Data

(60) Continuation-in-part of application No. 11/127,609, filed on May 12, 2005, and a continuation-in-part of application No. 11/247,830, filed on Oct. 11, 2005, now Pat. No. 7,665,264, which is a division of application No. 11/127,608, filed on May 12, 2005, now Pat. No. 7,165,370, which is a division of application No. 10/667,773, filed on Oct. 2, 2003, now Pat. No. 7,021,014.

(51) Int. Cl.
*E04B 1/02* (2006.01)

(52) U.S. Cl.
USPC ..... 425/182; 264/228; 264/229; 52/293.3; 52/602

(58) Field of Classification Search
USPC ..... 264/228, 229; 425/111, 182; 52/293.3, 52/602
See application file for complete search history.

(56) References Cited

U.S. PATENT DOCUMENTS 4,057,519 A * 11/1977 Summers et al. ..... 521/122
4,348,442 A * 9/1982 Figge ..... 428/72
4,671,032 A * 6/1987 Reynolds ..... 52/210

* cited by examiner

*Primary Examiner* — James Sanders

(57) ABSTRACT

A Fully Integrated Structural Building System has a pair of pre-stressed multi-stemmed concrete floors. The pre-stressed multi-stemmed concrete floors are adapted to contact each other on one parallel side edge to form peripheral edges and a central joining edge. A part of a building is coupled to a pre-stressed multi-stemmed concrete floor. The building is constructed with a primary structural frame and a secondary structural frame separated by a rigid foam spacer. The spacer is a Class I non-combustible closed-cell foam. The building is strong, energy efficient, non-combustible and easily transported from the factory to the building site. The building is Green and constructed only with renewable and recyclable materials.

4 Claims, 12 Drawing Sheets

FIG 2
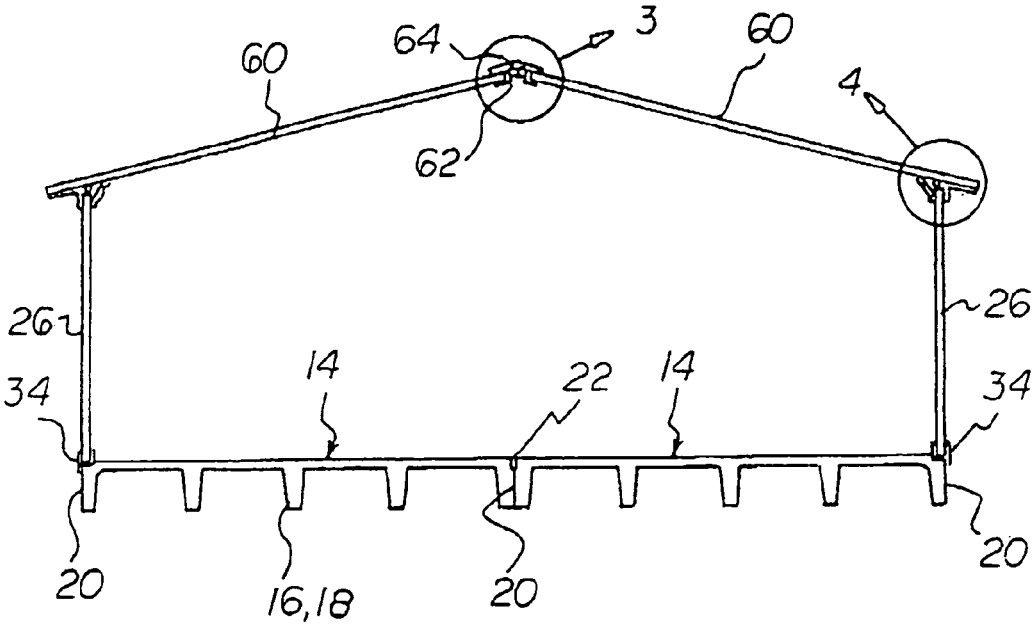
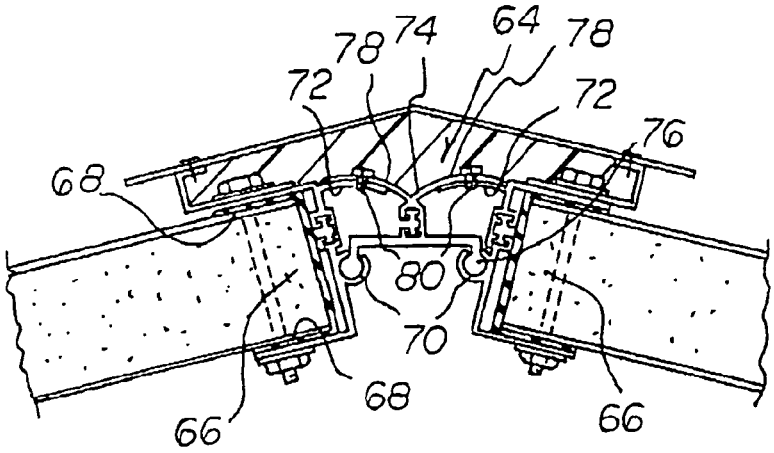
FIG 3

FIG 6
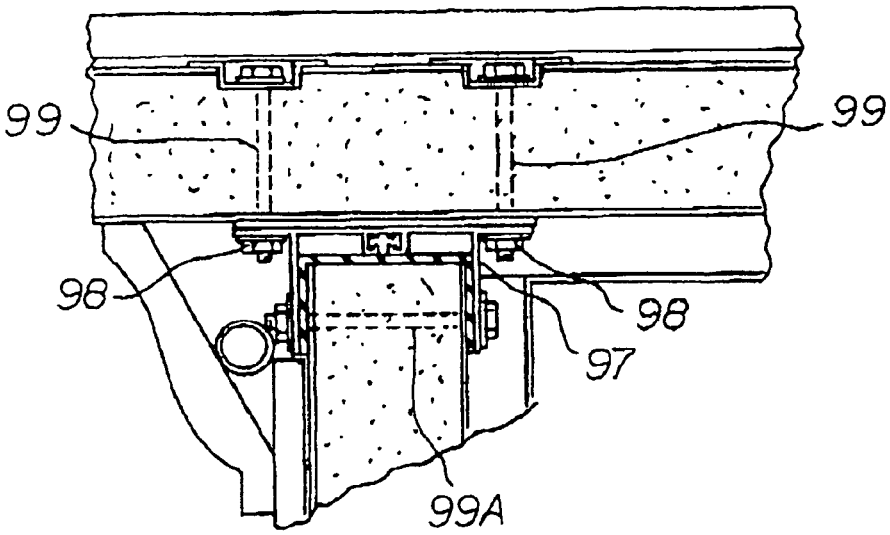
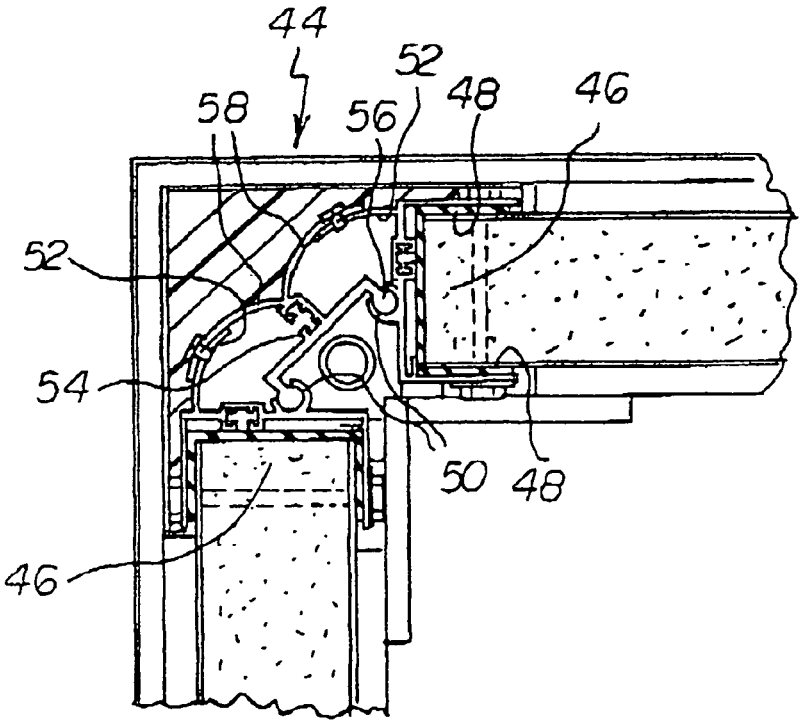
FIG 7

FIG 11
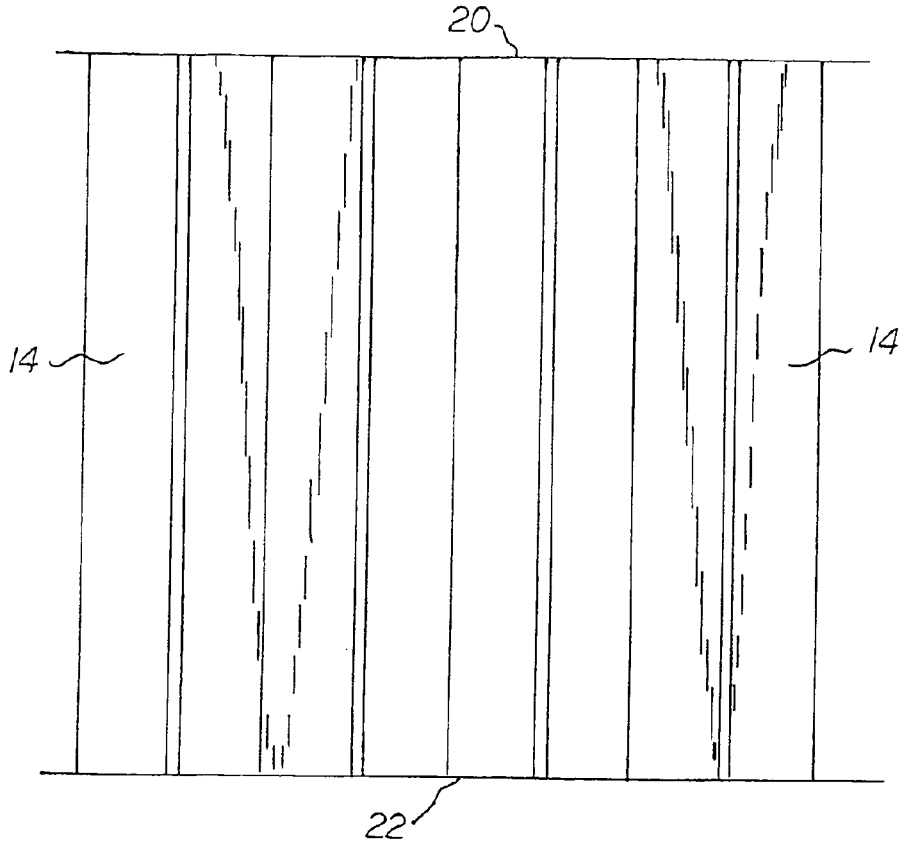
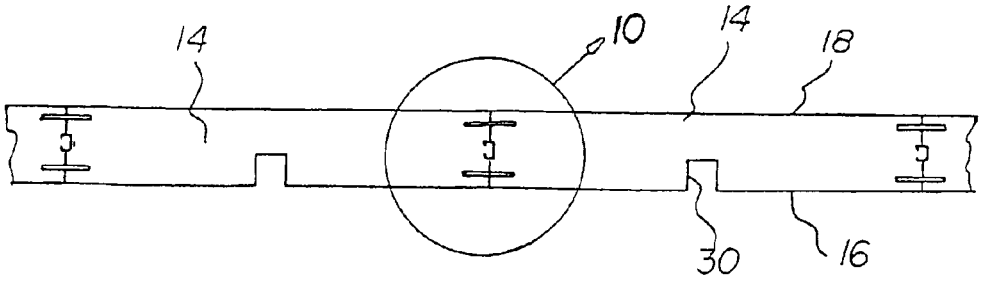
FIG 12

FIG 15
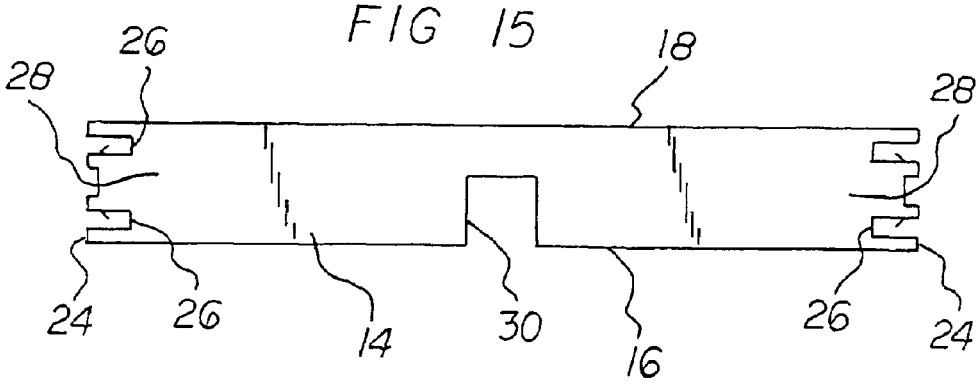
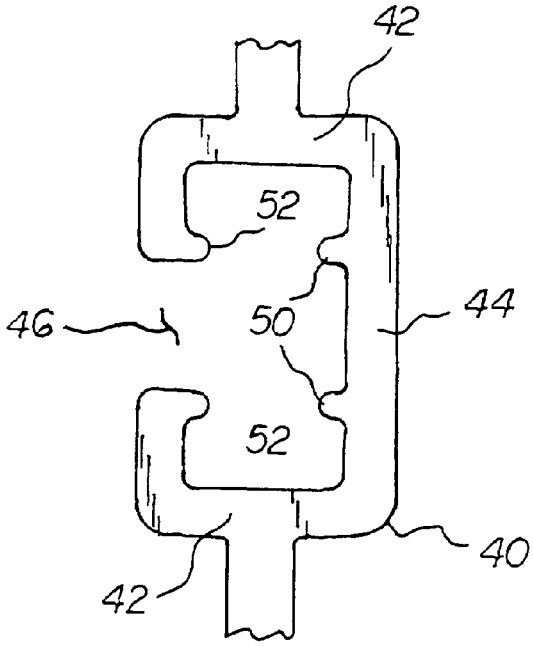
FIG 16

FULLY INTEGRATED STRUCTURAL BUILDING SYSTEM

RELATED APPLICATIONS

The present application is a continuation-in-part of co-pending application U.S. Ser. No. 11/127,609 filed May 12, 2005 entitled Concrete Floor Manufacturing Station which was a division of application U.S. Ser. No. 11/127,608 filed May 12, 2005 entitled Method of Transport, now U.S. Pat. No. 7,165,370 which was a division of application U.S. Ser. No. 10/667,773 filed Oct. 2, 2003 entitled Manufactured Building System, now U.S. Pat. No. 7,021,014 and the related continuation in part U.S. Ser. No. 11/247,830 filed Oct. 11, 2005 entitled Metal-Faced Building panels Having Angled Projections In Longitudinal Edge Recesses For Mating With Locking Ramps On Flanges Of Concealed Locking I-Shaped Connector, now U.S. Pat. No. 7,665,264.

BACKGROUND OF THE INVENTION

1. Field of the Invention

The present invention relates to a Fully Integrated Structural Building System and more particularly pertains to constructing pre-engineered and pre-fabricated single family homes, school classrooms, public restrooms, storage buildings and telecommunication buildings that are strong, non-combustible, highly energy efficient and Green. The building structure fully integrates a primary structural frame, a secondary structural frame with metal sheathing, rigid foam insulation and a multi-stemmed pre-stressed concrete floor that serves as the sole primary foundation when placed upon the building site. The concrete floor is easily manufactured according to the method described in the related U.S. Ser. No. 11/127,609. The Fully Integrated Structural Building System is easily transported from the manufacturing facility and installed upon the building site according to the related U.S. Pat. No. 7,165,370.

2. Description of the Prior Art

Generally, the manufactured building systems available in today's market incorporate designs and materials that have not been changed or improved for more than 30 years. Most transportable manufactured homes are built with conventional building materials such as wood stud frames, fiberglass batt insulation, wood siding, wood floors, wood roof trusses, asphalt roof shingles and a steel trailer frame with permanently attached wheels for transport from the factory to the building site. The weights of the materials used in the construction are relatively heavy when compared to the weight of the floor system or foundational materials resulting in a top-heavy structure with a high center of gravity. This is contrary to good engineering practice wherein it is known that a heavy foundation is needed to overcome the overturning, uplift and sliding forces exerted by high winds.

Because of the permanently attached wheels and steel trailer frame that also supports the wood floors, most manufactured buildings are erected on the building site by jacking the building up and placing concrete blocks under the trailer bed at specified locations. The building is then lowered onto the concrete block piers. The wheels remain attached to the steel trailer bed. This erection method results in a building that has the floor system elevated two to three feet above the ground. The space around the bottom of the building is enclosed around the perimeter with fencing, blinds, skirts or other apparatus designed to hide the concrete block piers and steel trailer bed from view. This type of building system is commonly referred to as the trailer look.

Because of the lightweight of the steel trailer bed, and other foundational elements, there is little resistance to high wind loads and the building can easily be blown off of the concrete piers during high winds. To prevent this problem, the manufacturers of this type of building system have devised an anchoring system that is intended to hold the building down to the concrete piers in order to resist overturning, uplift and sliding forces generated by high winds. The anchor system is comprised of steel rods that are driven into the ground to a specified depth and at specified intervals. Steel straps are then connected between the rods and the underside of the steel trailer bed and tensioned by means of a turnbuckle or other device that stretches the steel straps to exert a downward force on the building assembly. The manufacturers claim that this system is adequate to prevent uplift or overturning of their buildings during high winds and the applicable building codes are written to include tie-down straps as a condition precedent to the issuance of a certificate of occupancy.

Although the manufacturers claim that the tie down straps adequately withstand the wind loads, it is well known that conventional manufactured buildings are not safe for habitation during high windstorms. Although the tie down strap system offers some improvement in the structural strength of the building, it does not achieve the degree of structural strength that is needed to withstand hurricane force winds or that would be achieved with a floor system or foundation that is heavier than the structure above.

Alternate methods of anchoring the building to the ground have been devised including the construction of a concrete foundation consisting of footers and stem walls with concrete tie beams. The wooden modular building is transported to the building site on specially designed low-boy trailers and then lifted off the trailer with a large crane and placed upon the site-built concrete foundation. The building is then connected to the foundation with an appropriately designed anchor system. While this method of connecting the building to the ground is superior to the tie-down straps described above, it necessitates large expenditures of money for additional labor and materials that often add $10,000.00 to $15,000.00 or more in total project costs.

The wall construction of conventional manufactured buildings is generally comprised of wood studs with fiberglass batt insulation between the studs. The exterior side of the wall is generally covered with oriented strand board (OSB) and the interior side with gypsum board (drywall). The overall thickness of these walls is approximately 4 inches.

Because the walls are constructed with wood studs and are insulated with fiberglass insulation installed into a 4-inch thick cavity there are two resultant deficiencies. The most obvious deficiency is the highly flammable wood construction. These buildings burn very fast and are a fire hazard for the occupants. The second is the energy efficiency. Generally it is not possible to achieve an insulation or R-value greater than an R-11 with the 4-inch thick wall. These buildings are generally not very energy efficient.

Walls constructed with wooden materials are flexible and do not achieve the structural strength that can be achieved with other building materials such as steel, concrete or composite building panels. This places limits on the wind loads that a wood stud wall can withstand. In order to increase the strength of wood stud buildings to withstand the constantly increasing building codes it is necessary to include more studs spaced closer together in the wall. This increases the cost of construction and consumes more of our precious natural resource.

The roof system of conventional manufactured buildings is generally constructed with a wooden truss system. A wooden truss is a generally triangular shape with a bottom part that is flat and is connected from one side of the building to the opposite side of the building parallel with the floor. The two sloping halves of the roof are connected at the outermost side of the bottom part and slope upward to the connection at the roof ridge to form a triangle. Since the outside of the roof truss is covered with roofing materials such as plywood and shingles and the inside of the roof truss is covered with drywall, a cavity is created on the interior sides of the roof truss.

There are three problems inherent in this design. The first problem is with the excessive amount of heat that is known to build up inside the cavity. The open space inside the truss serves as a container that captures heat similar to an oven. This requires the building designers to incorporate a means to ventilate the heat to the building exterior. Although some heat can escape to the outside of the building through attic vents, most of the heat remains inside the roof truss cavity and escapes to the buildings interior. This places an excessive load on the air conditioning system and is not an energy efficient design.

The second problem is with the uplift forces exerted on a roof truss system during windstorms. It is well known that roof systems that are not made an integral and structural part of the overall building envelope can be blown off and separated from the building during high winds. Therefore the building manufacturers must incorporate a means to adequately tie the truss system to the outside walls of the building with straps or other means of mechanically fastening the truss system to the building walls. This is generally accomplished with tie down straps or truss brackets. Although these devices offer some resistance to uplift forces, it is generally known that this remains a weak part of the overall structure.

The third problem is that most roof trusses are constructed with wooden materials. As with the exterior walls this creates a fire hazard.

Roof trusses constructed with wooden materials are flexible and do not achieve the structural strength that can be achieved with other building materials such as steel, concrete or composite building panels. This places limits on the wind loads that a roof truss can withstand. In order to increase the strength of roofs constructed with wooden trusses to withstand more stringent and constantly increasing building codes, it is necessary to include more trusses spaced closer together. This increases the cost of construction and consumes more of our precious natural resource.

The floor systems of conventional manufactured buildings are generally constructed with wooden floor joists that are supported underneath with a steel trailer body constructed with steel channels and angles. The wooden joists are covered on the topside with oriented strand board or plywood panels. This floor system is relatively lightweight and does not achieve the structural strength that is found with a concrete floor.

A wooden floor system is relatively flexible and cannot support the weight of heavy objects such as refrigerators, dressers and other interior furnishings. Over time, these floor systems have a tendency to warp or bow from the furniture and other dead and live loads placed upon them.

A wooden floor system can burn easily and rapidly. This creates a fire hazard for the building occupants.

It can be thus appreciated that the use of manufactured building systems of known designs and configurations is known in the prior art. More specifically, manufactured building systems of known designs and configurations previously devised and utilized for the purpose of constructing buildings by known methods and apparatuses are known to consist basically of familiar, expected, and obvious structural configurations and building materials, notwithstanding the myriad of designs encompassed by the crowded prior art which has been developed for the fulfillment of countless objectives and requirements.

By way of example, U.S. Pat. No. 5,373,678 to Hesser issued Dec. 10, 1994, relates to a building panel. Hesser teaches a building panel that incorporates an internal stiffener stud that can be formed through the manufacturing process simultaneously with the exterior steel skins and polyurethane foam core. Hesser further teaches a means of connecting the building panels together with hand formed metal sheets and screws to form the walls and roofs for various buildings. There are limitations with this design because the hand made bent metal shapes cannot me made in long lengths and are not structurally strong. They cannot be made with an integral thermal break and a multitude of screws are required to connect the metal shapes to the thin skin of the building panel. The assembly design depicted in the Hesser patent is labor intensive, which results in excessive cost for material fabrication and erection. The Hesser design is not structurally strong because the metal shape itself does not control the positive and negative wind loads exerted on a building. The loads are exerted fully on the multitude of screws connecting the metal shape to the panel. Hesser does not teach an extruded aluminum structural framing system that can be manufactured in long lengths. Hesser does not teach an extruded aluminum connector system that includes an integral thermal break and that is adjustable to accommodate various roof pitches and vertical wall angles. Hesser does not teach an extruded aluminum structural framing system that is connected to the building panels with through bolts or that control the positive and negative wind loads through the connector itself. Hesser does not teach a metal sheathed wall assembly with concealed locking beams. Hesser does not teach a manufactured building system that is transported on a self-trailering multi-stemmed concrete floor system.

U.S. Pat. No. 5,509,242 to Rechsteiner issued Apr. 23, 1996, relates to a building panel system. Rechsteiner teaches a building panel that is reinforced by inserting steel angles, by hand, into the open edge after the panel is manufactured. This method of reinforcing a building panel is costly, due to higher material costs, and labor intensive, due to inserting the pieces by hand. Rechsteiner further teaches a method of connecting the panels together with the same hand made bent metal shapes taught in Hesser. In fact the only difference between Hesser and Rechsteiner is the method of reinforcing the building panel with hand inserted steel angles. Rechsteiner has the same limitations with the assembly of the building panels as described above in Hesser.

U.S. Pat. No. 6,101,779 issued on Aug. 15, 2000 to Davenport teaches a pre-cast concrete slab having a multi-bayed construction. The concrete slab depicted here relies on a multitude of beams, purlins and ribs to form a supporting structure that are reinforced with deformed reinforcing bar steel (rebar). The concrete slab depicted here is formed by laying a multitude of steel channels in different directions to provide a trough for forming the concrete. Many Styrofoam blocks are laid out between the steel channels to provide additional forming members for the concrete. In order to provide longitudinal support sufficient to hold the concrete together and avoid cracking during transport, a considerable amount of steel rebar and wire mesh is laid out on top of the steel channels and Styrofoam forms. The method of constructing the pre-cast concrete slab depicted in Davenport uses an excessive amount of steel that is all placed by hand.

This results in excessive material and labor costs. In fact, the concrete slab taught by Davenport is really the same steel support frame used in the manufactured building segment for the past 30 years but with concrete poured on the top. Furthermore, the steel bottom channels are exposed which makes the support frame susceptible to rust and corrosion.

For transport, the Davenport concrete slab must be lifted and placed on a steel trailer or bogey with wheels located at the front and rear of the unit. The wheels are not able to be located partially within the open spaces under the slab because of the multitude of cross beams, purlins and ribs formed to provide lateral support of the concrete. This causes the slab to be located above the height of the wheels and steel forming the trailer or bogey frame thereby increasing the space between the bottom of the slab and the roadway during transport. This causes the center of gravity to be higher than is desirable and limits the overall building height for passing under bridges and utility lines.

Davenport does not teach a multi-stemmed concrete floor that is manufactured by the pre-stressing method. Davenport does not teach a multi-stemmed concrete floor that transfers all of the longitudinal live and dead loads to a reinforced diaphragm header. Davenport does not teach a multi-stemmed concrete floor that is manufactured entirely of concrete and does not rely on an exposed steel frame for structural support. Davenport does not teach a multi-stemmed concrete floor that is transported by attaching a wheel assembly directly to the down turned stems. Davenport does not teach a multi-stemmed concrete floor that has wheels located on only the rear end. Davenport does not teach a multi-stemmed concrete floor that minimizes the clearance between the roadway and bottom side of the floor by concealing the upper ⅓ of the wheel within the open spaces between the down turned stems. Davenport does not teach a multi-stemmed concrete floor that is manufactured in a self-stressing steel form with a removable stressing block.

U.S. Pat. No. 3,944,242 issued on Mar. 16, 1976 to Eubank addresses the center of gravity problems inherent to a movable building, such as a prefabricated house and with the deficiencies inherent with pre-cast slabs as taught in Davenport. Eubanks teaches a concrete slab wherein the structural reinforcement of the concrete is made by the post-tensioning method, which is preferred to pre-casting. Although Eubanks refers to pre-stressing, a method of pre-stressing is not demonstrated by Eubanks. Eubanks teaches a concrete slab that is reinforced by post-tensioning in both the longitudinal and lateral directions. Without the lateral tensioning the Eubanks slab would easily break apart during transport. The forming bed depicted by Eubanks shows a form that has the two long side and two short side blocks forming the outer edge of the slab connected to a multitude of hydraulic rams. This allows the sides to by pulled away from the slab edges after the concrete has been poured and cured. It is necessary to make the sides removable in order to have access for the insertion and tensioning of the internal tensioning rods in both the longitudinal and lateral directions. The casting form depicted by Eubanks cannot be used to make a pre-stressed slab because the sides would collapse from the stress imposed by the stressing strands used in the pre-stressing method. Also, the tensioning of the slab after it has been cast and while it is still in the form would cause the inside face of the outermost side and end stems to be tightly compressed against the form thereby causing the slab to bind against the form and making it impossible to remove. This is why the Eubanks design never became commercially viable.

The method of transport depicted in FIG. 5 of Eubanks requires the use of a large and very heavy steel support frame to connect the multitude of wheels and axles depicted here. The method of transport depicted in FIG. 4 of Eubanks shows a wheel assembly connected to the outermost longitudinal stem with one wheel on the inside and one wheel on the outside. The outside wheel causes the overall width of the unit to be increased by approximately 12@ on each side. This is not desirable because the overall width of the slab that can be transported over the highway is limited by the DOT regulations for maximum allowable widths. This results in a slab that is two feet less than what may be required.

Eubanks does not teach a multi-stemmed concrete floor that has several longitudinal stems running in a parallel direction. Eubanks does not teach a multi-stemmed concrete floor with a reinforced diaphragm header. Eubanks does not teach a multi-stemmed concrete floor that is reinforced by pre-stressing in only the longitudinal direction. Eubanks does not teach a multi-stemmed concrete floor that does not require post-tensioning or pre-stressing in the lateral direction and that is entirely reinforced in the lateral direction through the reinforced diaphragm header. Eubanks does not teach a pre-stressed concrete floor. Eubanks does not teach a multi-stemmed pre-stressed concrete floor that is manufactured in a self-stressing steel form. Eubanks does not teach a multi-stemmed concrete floor that is manufactured in a steel form with permanently fixed long sides and a removable stressing block. Eubanks does not teach a multi-stemmed concrete floor casting form that relieves the compressive forces exerted on the casting form with a compressible filler assembly. Eubanks does not teach a multi-stemmed concrete floor that is transported by attaching a wheel assembly directly to the interior longitudinal stem with the wheels inside the outer extents of the floor thereby allowing the concrete floor to be manufactured to the maximum width that can be safely transported over the highway.

U.S. Pat. No. 7,021,014 issued to Wolfe on Apr. 4, 2006 teaches a manufactured building system consisting of multi-stemmed pre-stressed concrete floors that are manufactured with a concrete floor manufacturing station and that can be easily transported with a fifth wheel towing device and wheel assembly attached directly to the down-turned stems of the concrete floor. Wolfe also teaches vertically disposed walls attached to the concrete floor and sloping roofs attached to the vertical walls that are constructed with building panels such as those described in Hesser above. Wolfe also teaches a structural aluminum framing system that couples together the longitudinal edges of the wall and roof building panels at the base, eave, roof ridge, outside corners and sloping gable ends that is used to join together the wall and roof diaphragms to form a free standing structure.

Wolfe does not teach a manufactured building system that is constructed with vertically disposed wall assemblies that are constructed with an I-shaped structural aluminum concealed locking beam spaced at 24 inch intervals and connected to the structural aluminum base connector at the bottom and to the structural aluminum eave connector at the top. Wolfe does not teach an I-shaped structural aluminum concealed locking beam that is connected to the structural aluminum eave connector at the bottom and to the structural aluminum ridge beam at the top. Wolfe does not teach a metal sheathed insulated insert that fits between the vertically disposed concealed locking beams and permanently joined together and locked in place by the concealed locking beams.

U.S. Pat. No. 7,665,264 issued to Wolfe on Feb. 23, 2010 teaches metal sheathed insulated insert with recesses on the longitudinal edges that are used to receive the longitudinal edges of an I-shaped concealed locking beam that permanently joins together the metal sheathed insulated inserts and greatly increases the structural strength of the wall and roof assembly.

Wolfe does not teach structural aluminum concealed locking beams that are connected at the top and bottom to a structural aluminum framing system to form a free standing rigid frame. Wolfe does not teach vertically disposed wall and roof assemblies that are connected to a multi-stemmed pre-stressed concrete floor that is manufactured in a concrete floor manufacturing station and that can be easily transported with a fifth wheel towing device and wheel assembly.

Reference is made to U.S. Pat. No. 5,373,678 to Hesser, U.S. Pat. No. 5,509,242 issued to Rechsteiner, U.S. Pat. No. 6,101,779 issued to Davenport, U.S. Pat. No. 3,944,242 issued to Eubanks, U.S. Pat. Nos. 7,021,014 and 7,665,264 issued to Wolfe, etc.

While these devices fulfill their respective, particular objectives and requirements, the aforementioned patents do not describe a Fully Integrated Structural Building System that allows constructing pre-engineered and pre-fabricated buildings that are manufactured with a structural aluminum connector system having concealed locking beams that are connected to the structural aluminum framing system having metal sheathed insulated inserts connected to and located between the locking beams and having a multi-stemmed pre-stressed concrete floor system that is easily transported on with a fifth wheel towing device and wheel assembly.

In this respect, the manufactured building system according to the present invention substantially departs from the conventional concepts and designs of the prior art, and in doing so provides an apparatus primarily developed for the purpose of manufacturing pre-engineered and pre-fabricated buildings that can be easily transported and assembled and solves all of the problems inherent in the prior art.

Therefore, it can be appreciated that there exists a continuing need for a new and improved fully integrated structural building system, which can be used for constructing pre-engineered pre-fabricated buildings that can be easily transported and assembled. The present invention can withstand hurricane force winds, is highly energy efficient, is non-combustible, is insect proof and rot proof. The present invention further has a concrete floor and can withstand impact from large flying missiles. The present invention is a completely Green product because it does not use any wood or other non-renewable non-recyclable materials in the structure. The present invention utilizes concrete, aluminum and steel as the primary materials, all of which either contain a high percentage of recycled materials or can be easily recycled. In this regard, the present invention substantially fulfills this need.

SUMMARY OF THE INVENTION

The present invention provides an improved Fully Integrated Structural Building System. As such, the general purpose of the present invention, which will be described subsequently in greater detail, is to provide a new and improved Fully Integrated Structural Building System and method, which has all the advantages of the prior art and none of the disadvantages.

To attain this, the present invention essentially comprises a pair of multi-stemmed pre-stressed concrete floor systems. Each pre-stressed concrete system has a generally rectangular configuration with a short front edge and parallel rear edge. Each multi-stemmed pre-stressed concrete floor system also has a pair of long parallel side edges between the front edge and rear edge. The multi-stemmed pre-stressed concrete floor systems are adapted to contact each other on one parallel side edge to form peripheral edges and a central joining edge.

Next provided is a primary structural framing system constructed with a plurality of metal framing components. First provided are base connectors positioned at the lower edges of the wall assembly. Note FIG. 8. Each base connector has a first end with generally U-shaped flat faces connected to the concealed locking beams in the wall assembly adjacent to their lower edges. Each base connector also has a second end with components fix-ably positioned with respect to the concrete floor.

Next provided is a plurality of vertically disposed I-shaped concealed locking beams spaced equally at 24 inch centers along the long front edge and the short side edge of the concrete floor. Note FIG. 14. The concealed locking beams are connected to the base connector at the bottom and to the eave connector at the top. Each concealed locking beam has a length essentially equal to the length of the metal faced insulated inserts. Each concealed locking beam also has a generally I-shaped configuration with a central web and parallel flanges. The parallel flanges have a common length equal to the length of the central web plus or minus ten percent. The central web contains a thermal brake for thermal integrity with parallel short sides parallel with the end flanges and parallel long sides there between parallel with the central web. One of the long sides has a slot along its entire length. The long side with the slot has a pair of inwardly facing projections. The opposite long side has a pair of inwardly facing projections. The flanges each have end regions and a central region with the central region of each flange being of a thickness less than the end regions of each section to form a locking ramp. Each concealed locking beam is fabricated of a relatively rigid material selected from the class of materials including extruded aluminum, steel and thermo-plastic material.

Next provided are four adjustable corner connectors. Note FIG. 7. The four corner connectors are coupled to adjacent vertical edges of the wall assembly above the corners of the concrete floor systems. Each corner connector is constructed of a fixed first component having U-shaped flat faces secured to the adjacent vertical edges of the wall assembly. Each first component has a central cylindrical recess and an exterior arcuate first plate. Each corner connector also has an intermediate second component in a generally H-shaped configuration. The intermediate second component has interior cylinders rotatably received within the cylindrical recesses and with arcuate second plates in sliding contact with the first plates. Bolts fix-ably couple the arcuate plates at a predetermined angular orientation.

Next provided is a pair of adjustable eave connectors. The eave connectors are located on the top of the concealed locking beams and fixable coupled thereto. Each eave connector has a first component. The first component has a flat face connected at the bottom to a concealed locking beam with a central cylindrical component and an exterior first arcuate plate. Each eave connector also has a second component. The second component has a U-shaped flat face secured to the top of the concealed locking beam of the vertical wall assembly. The second component also has a central cylindrical recess and a second exterior arcuate plate in sliding contact with the first plate. Each adjustable eave connector has a bolt fix-ably coupling the arcuate plates at a predetermined angular orientation. This completes the primary structural frame for the wall assembly.

Next provided is a secondary framing system constructed with a plurality of vertically disposed metal sheathed insulated inserts used to enclose the structural frame and form the vertical wall assembly. Note FIG. 15. The metal sheathed insulated inserts are located between and permanently connected to the vertical concealed locking beams along the longitudinal edge. Each insert has an interior metal sheathing and an exterior metal sheathing with a horizontal upper edge and a parallel lower edge and with parallel longitudinal edges there between. The longitudinal edge of each metal sheathing has two parallel deep recesses. Each deep recess extends between the upper and lower edges. The interior metal sheathing of each insert has an electrical chase in a rectilinear configuration extending between the upper and lower edges equally spaced from the longitudinal edges. Each electrical chase has a width and depth greater than the width and depth of each deep recess. Each electrical chase is adapted to hold electrical wires and boxes when covered by an appropriate finishing sheet. The interior and exterior metal sheathing is uniformly spaced by a relatively rigid thermally insulating material selected from the class of rigid insulating materials including polyurethane foam and polystyrene foam.

The wall assemblies are associated with the peripheral edges. The wall assemblies extend upwardly from both the front and rear edges and the side edges remote from the central joining edge when the two concrete floor systems are adjacent to each other. In this manner a closed space is defined. The wall assemblies also have window openings and door openings.

Next provided is a primary structural framing system for the roof. A plurality of I-shaped concealed locking beams spaced equally at 24 inch centers are aligned along the top edge of the wall assembly. Note FIG. 13. The vertical locking beams are connected to the eave connector at the bottom and to the ridge beam connector at the top. Next provided is a plurality of concealed locking beams. Each concealed locking beam has a length essentially equal to the length of the metal faced insulated inserts. Each concealed locking beam, also has a generally I-shaped configuration with a central web and parallel flanges. The parallel flanges have a common length equal to the length of the central web plus or minus ten percent. The central web contains a thermal brake for thermal integrity with parallel short sides parallel with the end flanges and parallel long sides there between parallel with the central web. One of the long sides has a slot along its entire length. The long side with the slot has a pair of inwardly facing projections. The opposite long side has a pair of inwardly facing projections. The flanges each have end regions and a central region with the central region of each flange being of a thickness less than the end regions of each section to form a locking ramp. The interior and exterior sheathing is uniformly spaced by a relatively rigid thermally insulating material selected from the class of rigid insulating materials including polyurethane foam and polystyrene foam.

Next provided is an adjustable roof ridge connector. Note FIG. 5. The roof ridge connector is constructed of rotate-able components having U-shaped flat faces and arched flanges that may rotate about each other through a reasonable range of pitches. The fundamental apparatus for receiving the roof assembly is a three-sided member which generally describes a "U" or "C". Such would comprise three connected flat sides with two parallel side members which are joined by a perpendicular base member. The spacing between the two side members would be such as to snugly receive the roof assembly. The arched flanges are connected to one base member and one side member. The exterior arched flanges and the interior arched flanges are adapted to rotate about one another within a reasonable range of rotation. Bolts fixably couple the arched flanges at a predetermined angular orientation. This completes the primary structural frame for the roof assembly.

Next provided is a secondary framing system constructed with a plurality of vertically disposed metal sheathed insulated inserts to form the sloping roof assembly. Note FIG. 15. The metal sheathed insulated inserts are located between and permanently connected to the vertical concealed locking beams along the longitudinal edge. Each insert has an interior metal sheathing and an exterior metal sheathing with a horizontal upper edge and a parallel lower edge and with parallel longitudinal edges there between. The longitudinal edge of each metal sheathing has two parallel deep recesses. Each deep recess extends between the upper and lower edges. The interior metal sheathing of each insert has an electrical chase in a rectilinear configuration extending between the upper and lower edges equally spaced from the longitudinal edges. Each electrical chase has a width and depth greater than the width and depth of each deep recess. Each electrical chase is adapted to hold electrical wires and boxes when covered by an appropriate finishing sheet. The interior and exterior sheathing is uniformly spaced by a relatively rigid thermally insulating material selected from the class of rigid insulating materials including polyurethane foam and polystyrene foam.

The roof assemblies form a diaphragm associated with the peripheral edges. The roof assemblies extend upwardly from the top of the wall assembly to the ridge beam connector above the central joining edge when the two concrete floor systems are adjacent to each other. The roof assemblies are intermediately angled with respect to each other to form a linear ridge at the top parallel with and above the central joining edge of the concrete floors when the two roof assemblies are laterally aligned.

Next provided is a pair of gable end walls constructed with the metal faced insulated inserts and concealed locking beams. The gable end walls have a periphery there around. The gable end walls are intermediately angled with respect to each other to form a linear ridge at the top when the two gable end walls are aligned.

Next provided are gable end connectors coupled between the gable end wall assembly and the roof assembly. Note FIG. 6. Each gable end connector is in a C-shaped configuration with oppositely extending apertured flanges running parallel with the C-shaped channels. Bolts pass through the roof assembly and flanges to fixably connect the roof assembly to the gable end connectors. Another bolt also extends through the C-shaped channel and the top of the concealed locking beams of the gable end wall assembly for fixable coupling there between.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

OBJECT OF THE INVENTION

It is therefore an object of the present invention to provide a new and improved fully integrated structural building system, which may be built economically and sold at competitive prices in the single family home, school classrooms, restrooms, storage buildings and telecommunication buildings market.

It is therefore a further object of the present invention to provide a new and improved fully integrated structural building system which may be factory built under controlled conditions to assure quality control.

It is therefore another object of the present invention to provide a new and improved fully integrated structural building system which may withstand high wind loads in hurricane zones without the need to add external tie-down devices or expensive site-built concrete foundations.

It is therefore another object of the present invention to provide a new and improved fully integrated structural building system, which may withstand impact from large missiles in accordance with the new building codes for construction in hurricane zones.

It is therefore a further object of the present invention to provide a new and improved fully integrated structural building system which is completely non-combustible.

It is therefore a further object of the present invention to provide a structural building system that has a primary structural frame.

It is therefore further an object of the present invention to provide a structural building system that has a secondary framing system constructed with metal sheathing separated by rigid foam insulation to create a stress-skin condition whereby the exterior sheathing is put in compression and the interior sheathing is put in tension when perpendicular loads are exerted upon the wall and roof assemblies.

It is therefore a further object of the present invention to provide a new and improved fully integrated structural building system which is completely termite and insect proof.

It is therefore a further object of the present invention to provide a new and improved fully integrated structural building system which utilizes a wall and roof assembly that is constructed with lightweight but super-strong metal sheathed insulated inserts permanently joined together and reinforced with I-shaped concealed locking beams.

It is therefore a further object of the present invention to provide a new and improved fully integrated structural building system which is highly energy efficient and has a minimum R-28 rating in the exterior walls and R-32 rating in the roofs.

It is therefore a further object of the present invention to provide a new and improved fully integrated structural building system that withstands the overturning, uplift and sliding moments exerted by hurricane force winds without the need for external tie-down devices as is required for conventional manufactured homes or site-built concrete foundations as is required for conventional modular buildings.

It is therefore a further object of the present invention to provide a new and improved fully integrated structural building system that is completely open on the interior with cathedral ceilings throughout enabling the air conditioning or heating system to work within the entire building envelope thereby enhancing the overall energy efficiency.

It is therefore a further object of the present invention to provide a new and improved fully integrated structural building system that is constructed with a new and innovative multi-stemmed concrete floor system that is reinforced by the pre-stressing method in the longitudinal direction.

It is therefore a further object of the present invention to provide a new and improved fully integrated structural building system that is constructed with a new and innovative multi-stemmed concrete floor system that does not require pre-stressing or post-tensioning in the lateral direction but that has all of the lateral loads directed to and supported by a reinforced diaphragm header at both ends.

It is therefore a further object of the present invention to provide a new and improved fully integrated structural building system that is self-trailing and does not need an additional Gurney, bogey, flat bed trailer or any other supporting structure to transport the finished building.

It is therefore a further object of the invention to provide a self-trailing concrete floor system that can be moved over the highway with a minimal road clearance of 16" to 18" in order to maximize the roof pitch and still be able to clear the overhead bridges, utility lines, etc.

It is therefore a further object of the invention to provide a concrete floor system that is designed to tie together and transfer all of the longitudinal loads imposed on the long parallel down turned stems to a reinforced diaphragm header beam so that a fully unitized and strong structure is achieved.

It is therefore a further object of the invention to provide a concrete floor system that can be placed directly on the ground on 3'×3' pads placed only on the outside corners with all of the longitudinal loads transferred through the reinforced diaphragm header beam to the corner pads.

It is therefore a further object of the present invention to provide a new and improved fully integrated structural building system that is designed with the heavy elements of the structure at the bottom or in the foundation according to sound engineering principals.

It is therefore a further object of the present invention to provide a new and improved fully integrated structural building system that is constructed with a patented structural aluminum connector system.

It is therefore a further object of the present invention to provide a new and improved fully integrated structural building system that is constructed with a patented wall assembly constructed with concealed locking beams and metal sheathed insulated inserts.

It is therefore a further object of the present invention to provide a new and improved fully integrated structural building system that is constructed with building materials that are renewable and recyclable and do not deplete our precious and vanishing natural resources.

Lastly, it is an object of the present invention to provide a new and improved fully integrated structural building system. The system has a pair of multi-stemmed pre-stressed concrete floor systems. Each multi-stemmed concrete floor system has a generally rectangular configuration with parallel front and rear edges and parallel side edges. The concrete floor systems are adapted to contact each other on one parallel side edge to form peripheral edges and a central joining edge. Vertically disposed wall assemblies constructed with a primary structural frame and metal sheathed insulated inserts are associated with the peripheral edges extending upwardly from the edges remote from the central joining edge when the two floor systems are adjacent. Base connectors are positioned at the lower edges of the wall assemblies. Concealed locking beams are positioned at 24 inch centers between the base connector and eave connector. Four corner connectors are coupled to adjacent vertical edges of the wall diaphragms above the corners of the floor systems. Metal sheathed insulated inserts are located between the vertical concealed locking beams to complete the wall diaphragm. Roof assemblies each have a periphery there around and are intermediately angled with respect to each other to form a linear ridge at the top parallel with and above the central joining edge of the concrete floors when the two roof assemblies are laterally aligned. Concealed locking beams are located at 24 inch centers between the eave connector and ridge beam connector. An adjustable roof ridge connector and eave connectors with rotational axles and arcuate locking flanges are incorporated to maintain the roof diaphragms at a predetermined angular orientation. Metal sheathed insulated inserts are located between the vertical concealed locking beams to complete the roof diaphragm.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there the preferred embodiments of the invention are illustrated.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a cross-sectional view taken along line 2-2 of FIG. 1.

FIG. 3 is a cross-sectional view taken at circle 3 of FIG. 2 showing the roof ridge connector.

FIGS. 6 through 9 are cross-sectional views taken at intermediate points showing the various connectors including the gable end connector, corner connector, base connector and hip roof connector.

FIG. 11 is an interior view of the wall assembly depicting the edges joints and recess for the electrical chase.

FIG. 12 is a cross-sectional view of the wall assembly taken from the top down.

FIG. 15 is a cross-sectional view of the metal faced insulated inserts depicting the edge recesses and the interior recess for the electrical chase.

FIG. 16 is an enlarged view of the thermal brake located along the web of the I-shaped concealed locking beam.

The same reference numerals refer to the same parts throughout the various Figures.

DESCRIPTION OF THE PREFERRED EMBODIMENT

Figure 1:
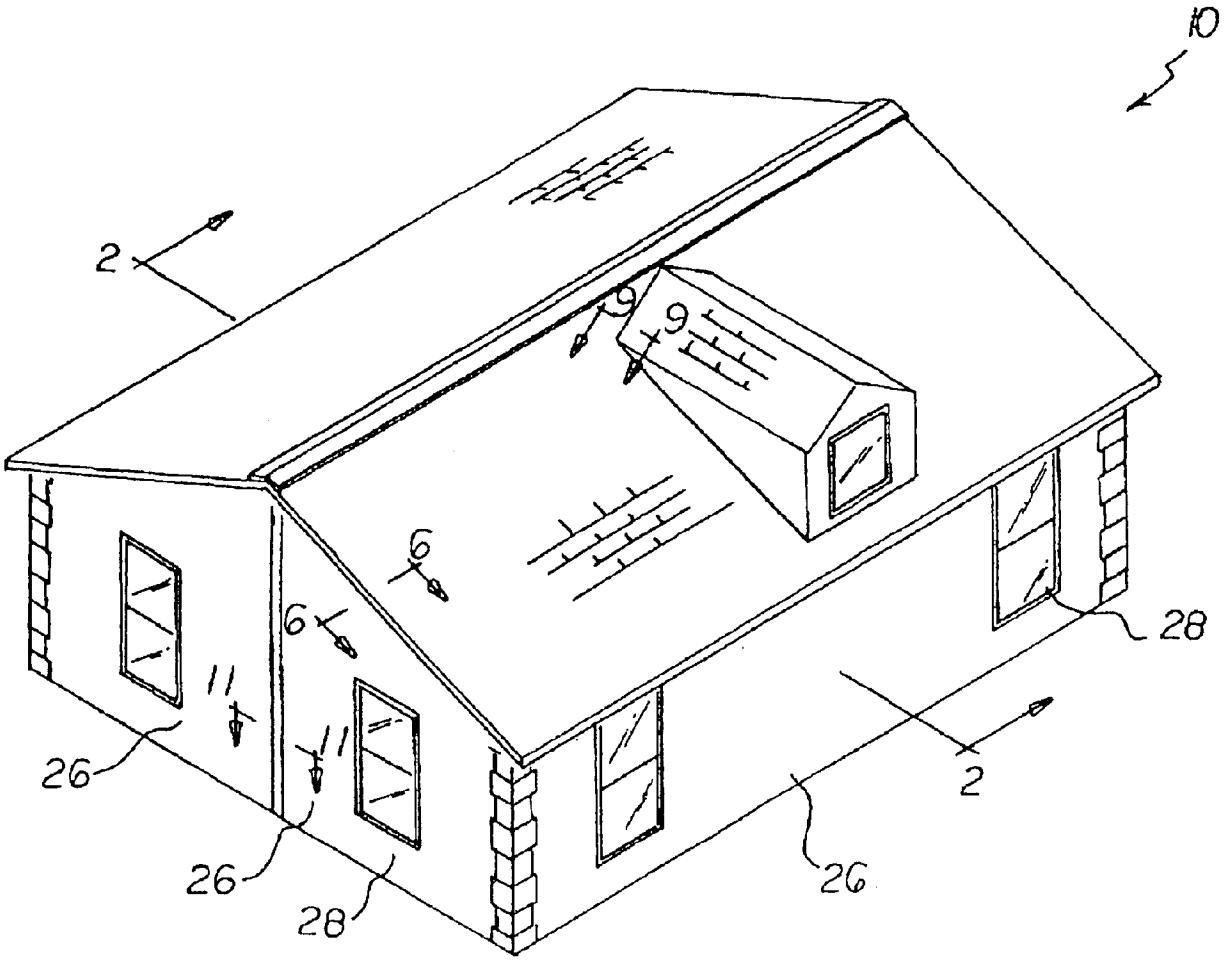
FIG. 1 is a perspective illustration of the manufactured building system constructed in accordance with the principles of the present invention.
Figure 4:
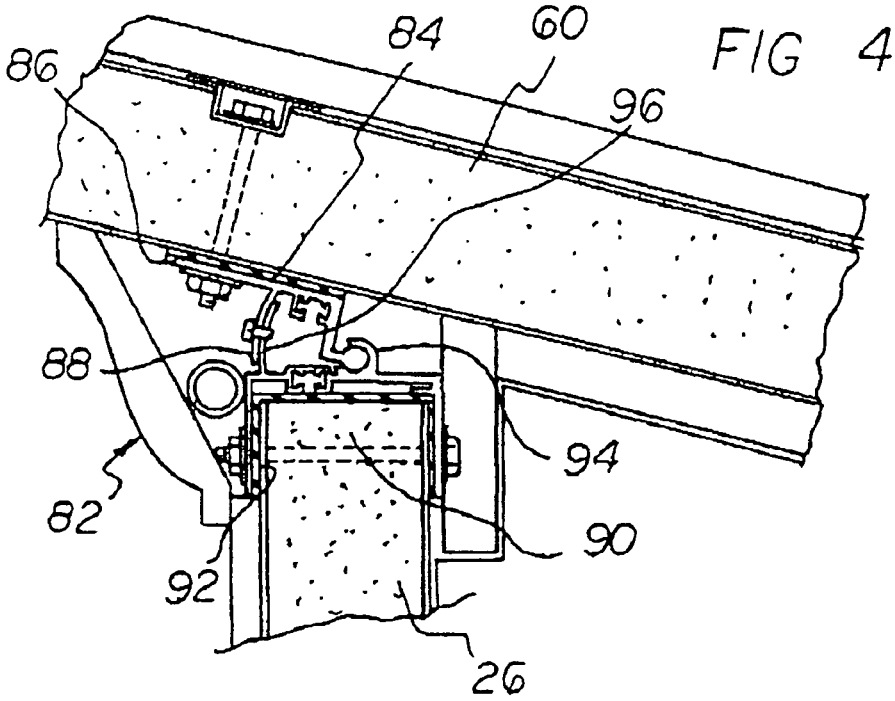
FIG. 4 is a cross-sectional view taken at circle 4 of FIG. 2 showing the connector between the roof and sidewall.

With reference now to the drawings, and in particular to FIG. 1 and FIG. 2 thereof, the preferred embodiment of the new and improved fully integrated structural building system embodying the principles and concepts of the present invention and generally designated by the reference numeral 10 will be described.

The present invention, the Fully Integrated Structural Building System 10, is comprised of a plurality of components. Such components in their broadest context include a pair of multi-stemmed pre-stressed concrete floor systems, a structural framing system including base connectors, concealed locking beams, four corner connectors, adjustable eave connectors, adjustable ridge beam connector, gable end connectors and a plurality of vertically disposed metal sheathed insulated inserts separated by rigid foam insulation. Such components are individually configured and correlated with respect to each other so as to attain the desired objective.

The Fully Integrated Structural Building System for constructing pr-engineered pre-fabricated buildings that can be easily transported and assembled has a pair of multi-stemmed pre-stressed concrete floors 14. Each multi-stemmed floor has a generally rectangular configuration with a short front edge 16 and parallel rear edge 18. Each multi-stemmed floor also has a pair of long parallel side edges 20 between the front edge and rear edge. The multi-stemmed floors are adapted to contact each other on one parallel side edge to form peripheral edges and a central joining edge 22.

A plurality of vertically disposed wall assemblies 26 are provided. The wall assemblies are associated with the peripheral edges. The wall assemblies extend upwardly from both the front and rear edges and the side edges remote from the central joining edge when the two floor systems are adjacent to each other. In this manner a closed space is defined. The wall assemblies also have window openings 28 and door openings (not shown).

Next provided are a plurality of base connectors 34 positioned at the lower edges of the wall assemblies. Each base connector has a first end 36 with generally U-shaped flat faces 38 receiving the wall assemblies adjacent to their lower edges. Each base connector also has a second end 40 with components fixably positioned with respect to the concrete floor.

Four adjustable corner connectors 44 are provided. The four adjustable corner connectors are coupled to adjacent vertical edges of the wall panels above the corners of the floor systems. Each corner connector is constructed of a fixed first component 46 having U-shaped flat faces 48 secured to the adjacent vertical edges of the wall panels. Each first component has a central cylindrical recess 50 and an exterior arcuate first plate 52. Each corner connector also has an intermediate second component 54 in a generally H-shaped configuration. The intermediate second component has interior cylinders 56 rotatably received within the cylindrical recesses and with arcuate second plates 58 in sliding contact with the first plates. Bolts fix-ably couple the arcuate plates at a predetermined angular orientation.

Next provided are a pair of roof diaphragms 60 constructed with concealed locking beams and metal sheathed insulated inserts. Each roof diaphragm has a periphery there around. The roof diaphragms are intermediately angled with respect to each other to form a linear ridge 62 at the top parallel with and above the central joining edge of the concrete floors when the two roof diaphragms are laterally aligned.

Figure 5:
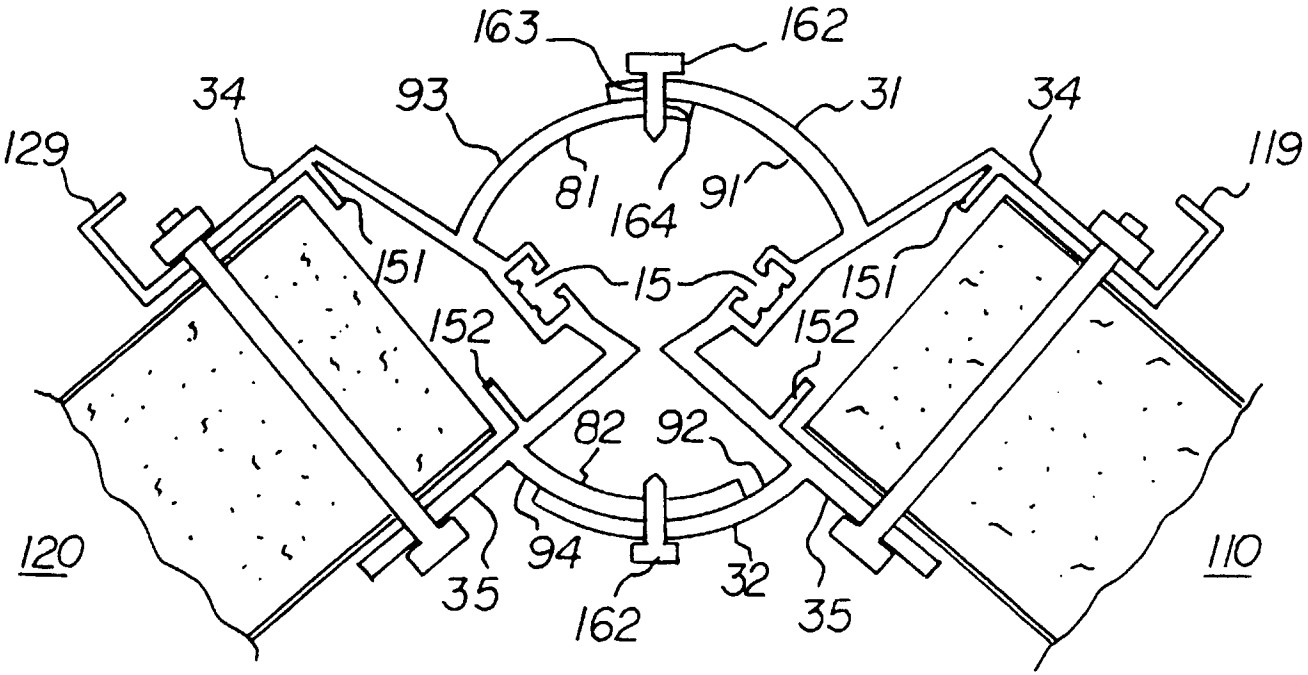
FIG. 5 is a cross-sectional view of the roof ridge depicting the "U"-shaped flanges attached to the roof assembly with through-bolts and the interior and exterior arched flanges designed to rotate about one another.
Figure 8:
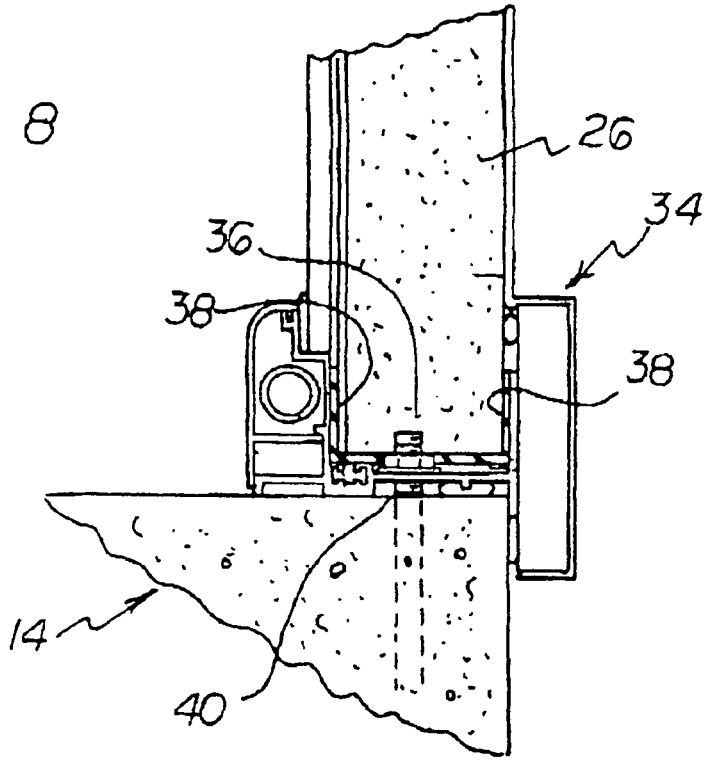
Figure 9:
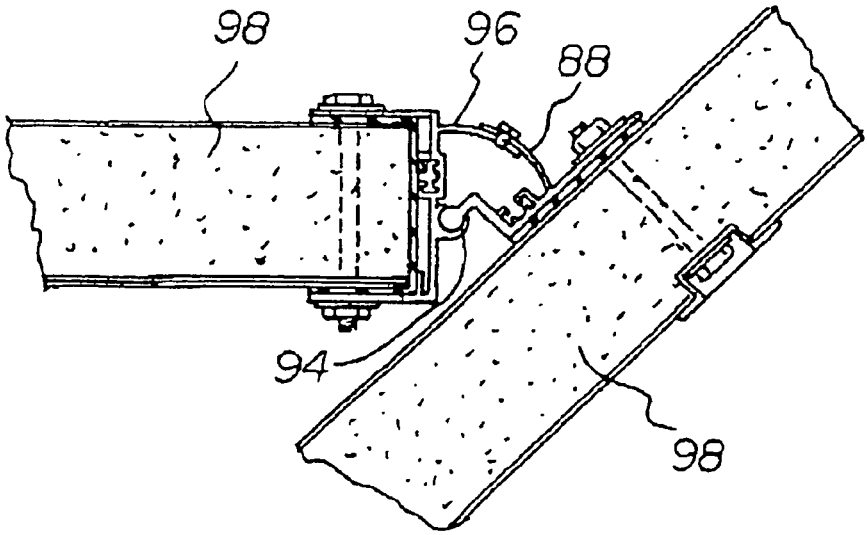
Figure 10:
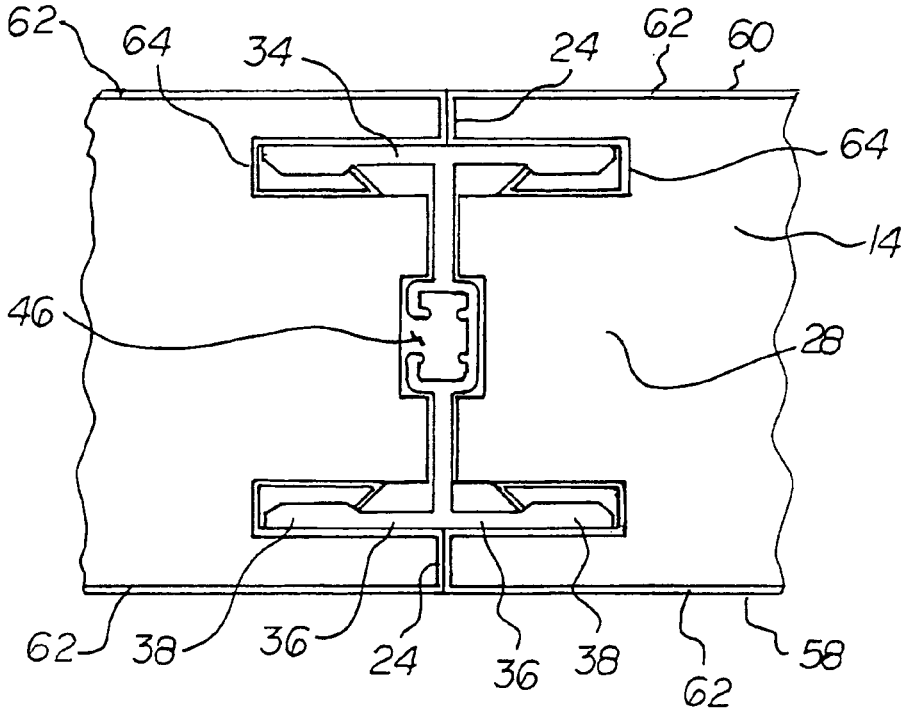
FIG. 10 is a cross-sectional view of the concealed locking beam engaged with the deep edge recesses of the interior and exterior metal sheathing.
Figure 13:
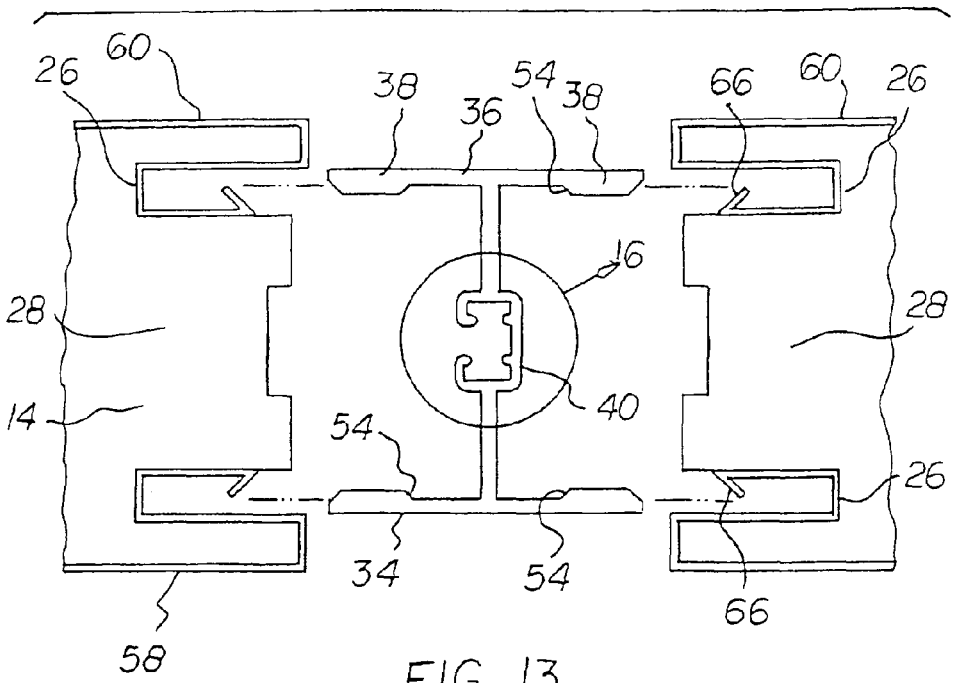
FIG. 13 is a cross-sectional view of the present invention similar to FIG. 10 with the metal faced insulated inserts separated.
Figure 14:
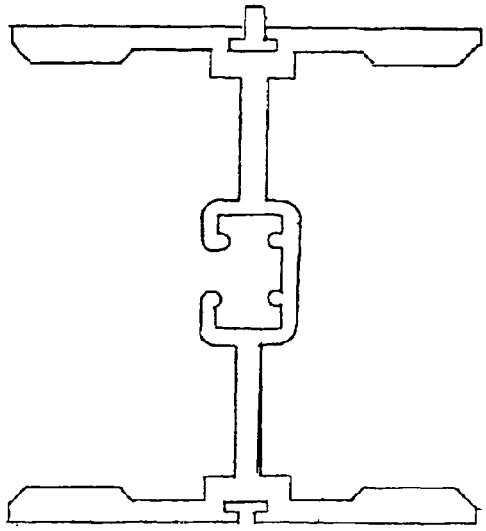
FIG. 14 is an enlarged cross-sectional view of the concealed locking beam.
Figure 17:
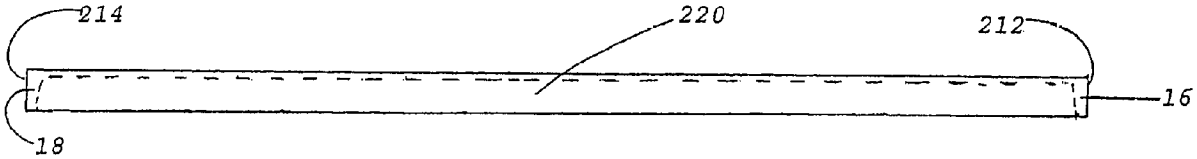
FIG. 17 is a side elevation view of the multi-stemmed concrete floor showing the front reinforced diaphragm header and the rear reinforced diaphragm header attached to and connecting the longitudinal down turned stems.
Figure 18:
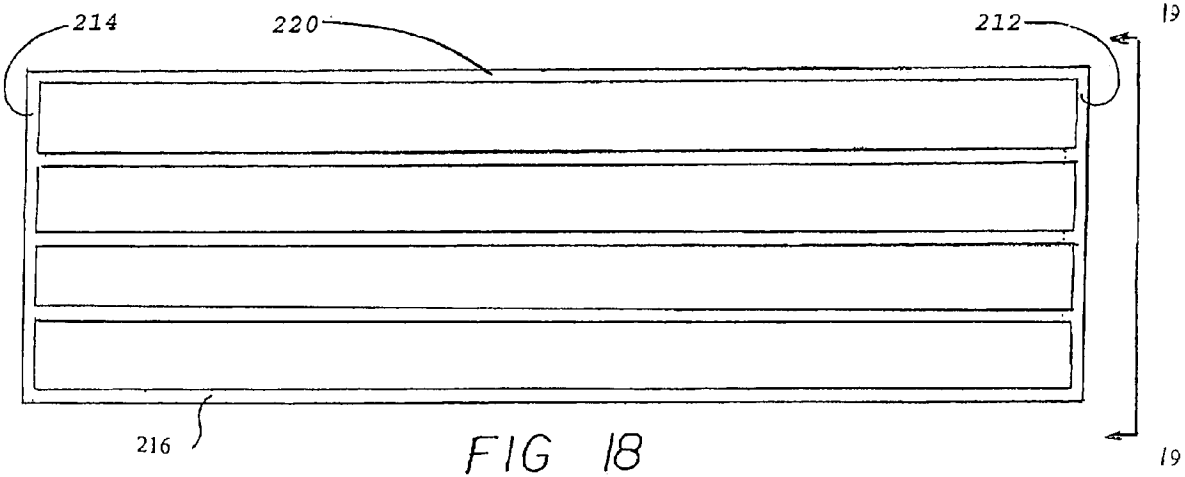
FIG. 18 is a plan view of the multi-stemmed concrete floor showing the down turned longitudinal stems connected to the reinforced diaphragm header 212, 214.
Figure 19:
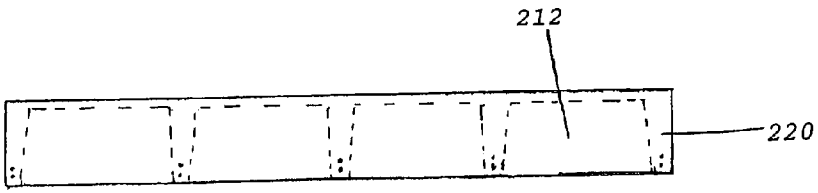
FIG. 19 is a section view of the multi-stemmed concrete floor taken along line 19-19 of FIG. 18, the view being through the reinforced diaphragm header to show the down turned stems with two stressing strands located near the bottom edge of each stem and the 2" thick flange connecting the stems together across the top surface.
Figure 20:
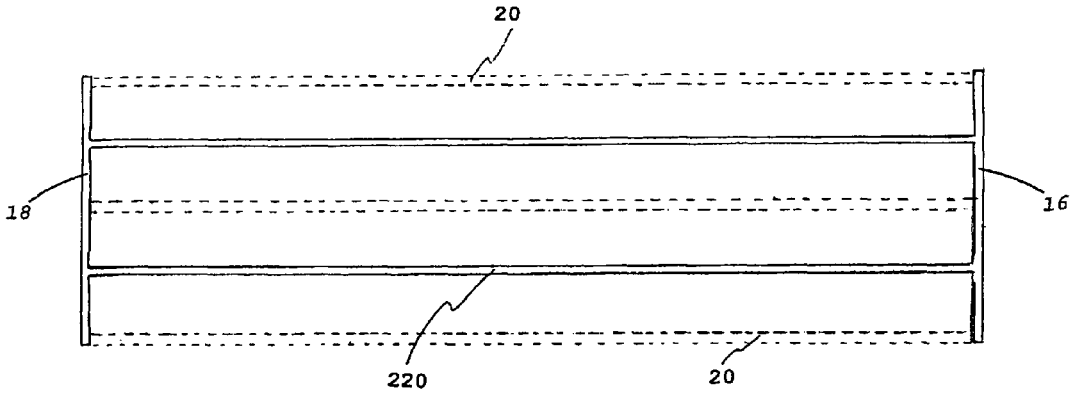
FIG. 20 is a plan view showing the main transport stems connected to and carrying the load of the reinforced diaphragm headers thereby forming a generally H shaped configuration. The transport stems are coupled to a transfer wheel assembly for the transportation of the floor system.
Figure 21:
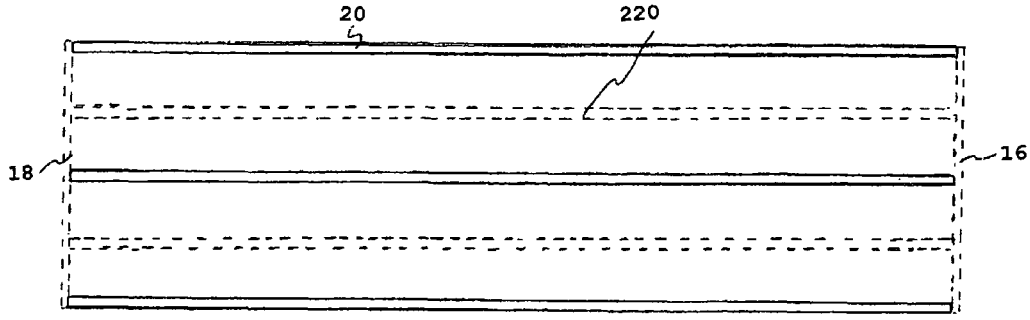
FIG. 21 is a plan view showing the additional support stems connected to and supported by the reinforced diaphragm header. The support stems are continuous with the diaphragm header and provide a stiffening of the system.

Next provided is an adjustable roof ridge connector. Note FIG. 5. The roof ridge connector is constructed of rotate-able components having U-shaped flat faces 34, 35 and arched flanges 31, 32, 93, 94 that may rotate about each other through a reasonable range of pitches. The fundamental apparatus for receiving the roof assembly is a three-sided member which generally describes a "U" or "C". Such would comprise three connected flat sides with two parallel side members 34, 35 which are joined by a perpendicular base member 15. The spacing between the two side members would be such as to snugly receive the roof assembly. The arched flanges are connected to one base member 15 and one side member 35. The exterior arched flanges 31, 32 and the interior arched flanges 93, 94 are adapted to rotate about one another within a reasonable range of rotation. Bolts 162 fix-ably couple the arched flanges at a predetermined angular orientation. This completes the primary structural frame for the roof assembly.

Next provided is a pair of adjustable eave connectors 82. The eave connectors are positioned between the upper edges of the wall panels and the inside of the roof diaphragms. Each eave connector has a first component 84. The first component has a flat face 86 coupled to a roof panel with a central cylindrical component and an exterior first arcuate plate 88. Each eave connector also has a second component 90. The second component has a U-shaped flat face 92 secured to the adjacent upper edge of the wall panels. The second component also has a central cylindrical recess 94 and a second exterior arcuate plate 96 in sliding contact with the first plate. Each adjustable eave connector has a bolt fixably coupling the arcuate plates at a predetermined angular orientation.

A pair of gable end wall assemblies 26, constructed with concealed locking beams and metal sheathed insulated inserts is provided. The gable end wall assemblies have a periphery there around. The gable end wall assemblies are intermediately angled with respect to each other to form a linear ridge at the top when the two gable wall assemblies are aligned.

Each gable end connector 97 is in a C-shaped configuration with oppositely extending apertured flanges 98 running parallel with the C-shaped channels. Bolts 99 pass through the roof diaphragms and flanges to fixably connect the roof diaphragms to the gable end connectors. Another bolt 99A also extends through the C-shaped channel and the vertical gable end wall assembly for fixable coupling there between.

A new an improved building system 10 includes a plurality of metal sheathed insulated inserts FIG. 11 formed of interior and exterior metal sheathing separated by rigid foam insulation. Each metal sheathed insulated insert is fabricated in a rectangular configuration with a short upper edge 20 and a parallel lower edge 22 and with a longer inner side edge 24 and a parallel outer side edge 26 there between. Each metal sheathed insulated insert also has exterior sheathing 18 and a parallel interior sheathing 16. One side edge 24 of each metal sheathed insulated insert has two deep recesses configured to receive the locking flange of the concealed locking beam 38.

The prior art including the Hesser and Rechsteiner patents attempt to provide additional strength to building panels by incorporating reinforcing members that run parallel with the longitudinal edge of the building panels. Neither invention contributes sufficient strength to allow the building designer to design free-standing rigid frame buildings that can withstand the wind and snow loads set forth in the various building codes governing the construction of single family homes, pre-manufactured homes and school classrooms in the United States. Neither invention provides a recess on the interior face of the building panel that can be used for the passage of electrical wiring, communications or plumbing. Neither invention incorporates vertically oriented concealed locking beams needed to withstand increased wind and snow loads or longer unsupported spans. Neither invention allows the concealed locking beam to be connected by thru-bolts to other structural connectors thereby creating a primary structural frame so that the entire connector system becomes an integral and structural part of the building.

In today's rapidly changing world there are many new advances in the fields of science, technology, medicine and other fields such as the building industry. The building industry is constantly looking for ways to construct buildings faster, more economically, stronger and with materials that are renewable and do not pollute the environment. Eventually our natural resources, such as the oil that is consumed to produce many building materials and the trees that are used to produce wood framed structures, will be depleted. The shortage of these raw materials is driving the cost for building materials higher. Over the past thirty years, the cost to construct single-family homes, pre-manufactured housing and school classrooms has skyrocketed. In the face of these economic and environmental conditions it is necessary to develop alternate building materials and Modern Methods of Construction that are structurally sound, energy efficient, non-combustible, cost effective and environmentally safe.

Buildings constructed with steel, concrete, aluminum and rigid foam insulation answer these needs. As with any new product, the design development is often a matter of trial and error. Both the Hesser and Rechsteiner patents identify the potential application for building panels in the manufacture of free standing rigid frame buildings. Both recognize the need to solve the problem of flexibility and/or excessive deflection under wind and snow loads and both offer a potential solution. However, neither solution is adequate to provide the amount of reinforcing required to support the use of building panels in free standing rigid frame structures. These patents can only be considered trials in the development of this alternate building system.

The present invention depicts a Modern Method of Construction providing an integral primary structural frame constructed with structural aluminum base connectors, concealed locking beams, outside corner connectors, eave connectors, gable end connectors and ridge beam connectors answers this need.

The present invention depicts a Modern method of Construction providing a secondary structural frame constructed with metal sheathed insulated inserts permanently connected at the side edges to the concealed locking beams which in turn are through-bolted at the top and bottom to the primary structural frame answers this need.

The present invention depicts a Modern Method of Construction providing a pair of multi-stemmed pre-stressed concrete floors 200 answers the need for a transportable building having the heavy elements located at the bottom so as to resist wind loads and other forces exerted upon the structure according to sound engineering practice. Each multi-stemmed pre-stressed concrete floor has a generally rectangular configuration with an up side and a down side and a thickness there between. Each multi-stemmed pre-stressed concrete floor has two parallel side edges and two parallel end edges, with one end edge being the front end and one end edge being the rear end. Each multi-stemmed pre-stressed concrete floor has a downwardly disposed short front reinforced diaphragm header 212 and a parallel downwardly disposed rear reinforced diaphragm header 214 and a plurality of long downwardly disposed stems there between. All stems 220 of each multi-stemmed pre-stressed concrete floor are perpendicular to the reinforced diaphragm headers and all stems have a pair of stressing cables running the length of the stems and through the front diaphragm header and through the rear diaphragm header. Two of the stems of each multi-stemmed pre-stressed concrete floor are located on and contiguous with the side edges of the multi-stemmed pre-stressed concrete floor and form the side edges of each multi-stemmed pre-stressed concrete floor. The side edge of a multi-stemmed pre-stressed concrete floor is configured to contact the side edge of another multi-stemmed pre-stressed concrete floor to form a central joining edge of the coupled multi-stemmed pre-stressed concrete floors to form a floor system of a building. The stems of each multi-stemmed pre-stressed concrete floor are the inner stems and the edge stems. The inner stems are between the two edge stems.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is a Modern Method of Construction as follows:

1. A Fully Integrated Structural Building System for the construction of non-combustible buildings comprised of the following non-combustible materials:

a transportable concrete floor system with two parallel long sides and two parallel short sides, the floor system having a plurality of down-turned stems running parallel with the two long sides, a steel reinforced diaphragm header, said down turned stems coupled to said steel reinforced diaphragm header and running parallel with the two short sides;

a primary structural frame coupled to the floor system and consisting of adjustable connectors manufactured with an aluminum alloy having up to 70% recycled content, said connectors being thermally broken by a non-metallic spacer for improved thermal efficiency;

a secondary structural frame coupled to the floor system and manufactured with carbon steel and having up to 70 percent recycled content;

metal-faced insulated inserts having metal facings and a Class I non-combustible rigid polyurethane foam spacer having high thermal values; and the long sides having recesses, I-shaped metal studs utilized to loin together the long sides of the metal faced insulated inserts concealed within the recess of the long sides.

2. A Fully Integrated Structural Building System for the construction of highly energy efficient buildings comprised of the following thermally efficient materials:

a transportable concrete floor system with two parallel long sides and two parallel short sides, the floor system having a plurality of down-turned stems running parallel with the two long sides, a steel reinforced diaphragm header, said down turned stems coupled to said steel reinforced diaphragm header and running parallel with the two short sides;

a primary structural frame coupled to the floor system and consisting of adjustable connectors manufactured with an aluminum alloy having up to 70% recycled content, said connectors being thermally broken by a non-metallic spacer for improved thermal efficiency;

metal-faced insulated inserts having metal facings and an insulating spacer of Class I non-combustible rigid polyurethane foam having high thermal values; and the long sides having recesses, I-shaped metal studs utilized to join together the long sides of the metal faced insulated inserts concealed within the recess of the long sides.

3. A Fully Integrated Structural Building System for the construction of recyclable buildings comprised of the following recyclable and renewable materials:

a transportable concrete floor system with two parallel long sides and two parallel short sides, the floor system having plurality of down-turned stems running parallel with the two long sides, a steel reinforced diaphragm header, said down turned stems coupled to said steel reinforced diaphragm header and running parallel with the two short sides;

a secondary carbon steel frame coupled to the floor system and having up to 70% recycled content;

a primary structural aluminum frame coupled to the floor system and having up to 70% recyclable content;

metal-faced insulated inserts;

the long sides having recesses, I-shaped metal studs utilized to join together the long sides of the metal faced insulated inserts concealed within the recess of the long sides.

4. A Fully Integrated Structural Building System comprising all of the components necessary for the construction of structurally strong buildings including:

a transportable concrete floor system with two parallel long sides and two parallel short sides, the floor system having a plurality of down-turned stems running parallel with the two long sides, a steel reinforced diaphragm header, said down turned stems coupled to said steel reinforced diaphragm header and running parallel with the two short sides;

a primary structural frame coupled to the floor system and consisting of adjustable connectors manufactured with thermally improved aluminum alloy, said connectors being thermally broken by a non-metallic spacer for improved thermal values;

a secondary structural frame coupled to the floor system and manufactured with carbon steel;

metal faced insulated inserts having metal facings and a Class I non-combustible rigid polyurethane foam spacer; and the long sides having recesses, I-shaped metal studs utilized to join together the long sides of the metal faced insulated inserts concealed within the recess of the long sides.

* * * * *